United States Patent [19]

Garcia

[11] Patent Number: 4,971,574

[45] Date of Patent: Nov. 20, 1990

[54] SHIELDED CONNECTOR ASSEMBLY FOR FLAT CABLE

[75] Inventor: Rudy J. Garcia, Round Rock, Tex.

[73] Assignee: W. L. Gore & Associates, Inc., Newark, Del.

[21] Appl. No.: 447,958

[22] Filed: Dec. 8, 1989

[51] Int. Cl.[5] ..... H01R 13/643
[52] U.S. Cl. ..... 439/497
[58] Field of Search ..... 439/497, 607–610

[56] References Cited

U.S. PATENT DOCUMENTS

| | | | |
|---|---|---|---|
| 4,420,201 | 12/1983 | Stephenson | 339/14 R |
| 4,605,269 | 8/1986 | Cohen et al. | 339/17 LC |
| 4,687,263 | 8/1987 | Cosmos et al. | 439/108 |
| 4,721,483 | 1/1988 | Dickie | 439/497 |
| 4,817,281 | 4/1989 | Sugawara | 439/497 |
| 4,880,388 | 11/1989 | Beamenderfer et al. | 439/497 |

*Primary Examiner*—Joseph H. McGlynn

[57] ABSTRACT

A thin fully-shielded connector assembly of a shielded flat ribbon cable with a connector having complete shielding from the cable through the connector to a fully-shielded matting receptacle of a printed circuit board.

9 Claims, 4 Drawing Sheets

SHIELDED CONNECTOR ASSEMBLY FOR FLAT CABLE

FIELD OF THE INVENTION

The invention pertains to the field of connector assemblies of flat electrical signal cables with shielded connectors.

BACKGROUND OF THE INVENTION

In order to prevent electromagnetic and radio frequency interference in modern fully-shielded flat electrical signal cable assemblies, a metal connector shield utilizing a means of mechanical termination to the ground shield of the flat cable is used over one-tenth inch by one-tenth inch grid connectors. Although providing three hundred sixty degree shielding, the connection does little to control impedance through the connector. The present connectors are also twice the thickness of typical fully-shielded flat cables owing to their insulation displacement connector (IDC) pin arrangement.

The loss of impedance control of the cable connector assembly gives reduced electrical performance. An ideal situation would be a fully-shielded coaxial cable with an impedance matched connector. The shielded flat cable can approach this performance by having its metallic shields closely formed around each primary signal conductor. In the past this has been done only to have the impedance mismatch of the connector degrade the performance of the cable.

SUMMARY OF THE INVENTION

In order to closely match the properties of the ideal coaxial assembly and reduce connector size, an assembly of a connector body with sockets on centers matching the centers of the signal conductors of a shielded flat cable is combined with an insulation layer, usually a wrap of insulative tape, with metallic shields which generally conform to the dimensions of the shields of the cables, and plastic strain relief covers to form an assembly which connects to a printed circuit board via a fully-shielded mating receptacle for the assembly. The assembly achieves a match of properties between the connector and a shielded flat cable which does not degrade the performance of the cable and which takes up half the connector assembly thickness of prior connectors. The connector uses half the space currently used for flat shielded cables on five-hundredths inch centers or less is three hundred sixty degree-shielded from electromagnetic and radio frequency radiation, and is impedance-matched to the cable. Connectors having contacts of even smaller spacing can be utilized, such as twenty-five-hundredths inch center spacing.

DETAILED DESCRIPTION OF THE INVENTION

Figure 1:
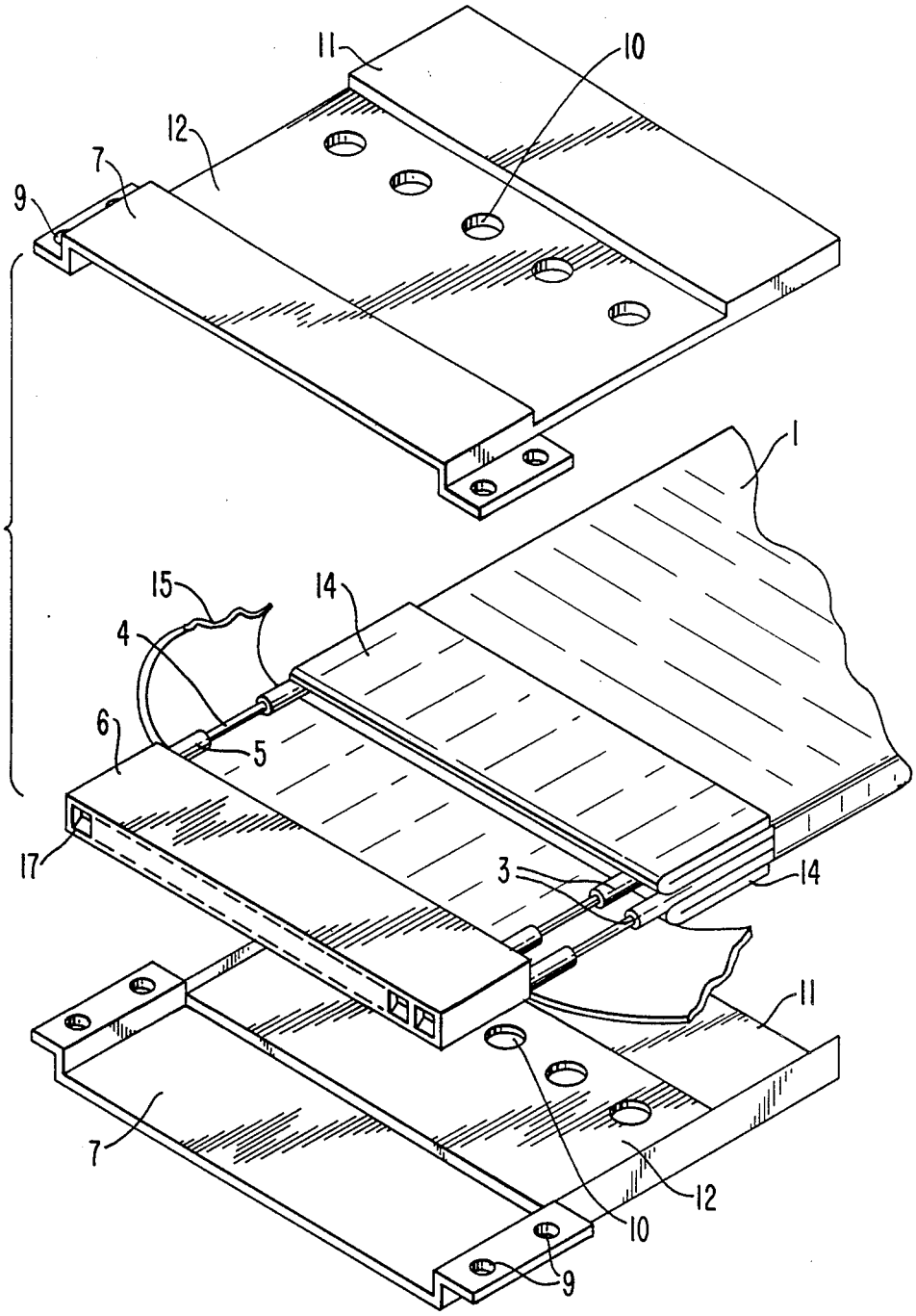
FIG. 1 shows an exploded perspective view of the connector shield parts surrounding the connector body which is attached to a flat ribbon cable.

The connector bOdy pOrtiOn of the invention comprises a grid of standard contact pins, which may be either of male or female configuration. The pins are a twisted metal spring pin design or an expanded pin structure for mating with a socket of opposite configuration for electrical and mechanical connection. Female sockets having a dimple or a constricting bead protruding into the interior of the cylinder or a springy zone of metal in their walls could also be used. The insulating material encompassing the pins is a rigid thermoplastic such as Ryton® polyphenylene sulfide thermoplastic or other well known connector insulating materials. The pins are recessed into the insulating material in a hollow cavity to protect them.

All pins are held on 0.050 inch center to center spacing and have the ends exposed for wire termination. Crimping to posts or crimping receptacles is the preferred method although a type of insulation displacement termination can be utilized or soldering to a soldering cup or other suitable receptacle.

The cable, being a flat ribbon cable with highly conductive shields on both sides of the cable, is prepared for use by folding the conductive shields back and exposing the primary conductors. The insulation from the primary conductors can be laser-stripped or stripped by other thermal means or by mechanical means to yield a uniform cut across the cable. The wires with center to center spacing of 0.050 inch can now be inserted into the solder cups for terminating to the connector. An insulative protective film is then placed over the exposed termination sites, such as Kapton® polyimide or aramide film, fluorocarbon film, microporous polytetrafluoroethylene film, or other films of equivalent insulating properties. It is understood that to further control the impedance of the assembly through the connector, a material with a specified dielectric constant or a semiconductive material such as a conductive GORE-TEX® microporous polytetrafluoroethylene material can be placed between the insulative tape and the connector shield.

The cable shields, which were previously folded back,-are now prepared for soldering, conductive adhesive bonding, or conductive polymer film pressure termination to the connector shields. The connector shields are next applied to both sides of the connector body, aligning the shields with the connector body end. The connector shields are made of a highly conductive rigid material such as brass with a protective plating. The shields are shaped closely to the outside dimensions of the connector and cable. With the connector shields in place and clamped together using screws or being welded together, the shields are soldered to the previously folded cable shield. This is done through the connector shield via soldering holes above the exposed cable shield. A good electrical and mechanical termination has now been made from the cable shield to the connector shield.

The connector shield also extends above the insulative cable jacket. By means of adhesive, the shield is bonded to the cable jacket for increased strain relief. An alternative method would be to place mechanical gripping teeth on the shield where it covers the cable jacket to bite into the jacket material when a normal force is applied to its face.

To aid in the strain relief of the termination, a rigid insulative protective cover is connected over the jacket/shield interface behind the connector body. The cover consists of two identical insulative parts that are placed on each side of the cable locking onto the indented part of the connector shield. The covers are latched by means of ultrasonic welding or by mechanical latches.

The connector shields extend past the side edges of the connector body to allow for clamping the two halves together. The edges also allow a means of latching the connector to its mating half. This could be done by using two swinging arms which latch on top of the shield edges. The pivot of the arms is on the mating connector.

A connector mating half is mounted on the circuit board. The connector rests on the board with the posts in a single row on 0.050 inch center to center spacing. The post extends above the insulative material that holds the connector together. A shield termination or grounding means for the connector shield to the circuit board is provided via a highly conductive friction fit spacing contactor. This could be a metal sheet formed along the connector bowing outward at the connection interface. The contactor with its tines would be shaped inwardly toward the center of the connector. The tines and contactor are of a material which has springy properties, such a beryllium copper with a protective plating. This would accommodate repeated plugging and unplugging during its life with small changes in its contact normal force. The tines would open when the connector assembly with its shield in place is inserted into the mating contactor. This would allow a continuous electrical path for the cables ground/shield to the circuit board. The contactor shield is terminated to the PCB around the base of the contactor body.

Referring now to the drawings, FIG. 1 is an exploded perspective of a pair of metal connector shield halves 7, 11, 12 above and below flat shielded ribbon cable 1 which is attached to insulated connector body 6. Solder cups 5 have been soldered to primary conductors 4 which are surrounded by insulation 3 within cable 1. Cable shielding 14 has been folded back on itself above and below cable 1 and lies in place to be soldered to the halves of the connector shielding in area 12 of the connector shielding halves. Holes 10 have been inlet into the connector shields in area 12 to facilitate the solder connection with area 14 of the cable shield. Insulating ribbon 15 is shown unwrapped from around primary conductors 4, solder cups 5, and insulation 3, but in place to enclose those parts with a wrap of insulation, which may be Kapton® polyimide or other insulative tape of equivalent properties. Several turns or layers of tape may be used, sufficient to properly insulate the connection area from the connector shield halves. Insulative plastic connector body 6 is shown with recesses 17 which may be rectangular or circular, in its forward face for access to connector pins imbedded inside connector body 6 by pins of the opposite male or female configuration. The opposite end of the pins form solder cups 5 or crimping posts. Holes 9 in the connector shielding facilitate fastening the two halves of the shielding together around the cable and connector by bolts, soldering or welding.

Figure 2:
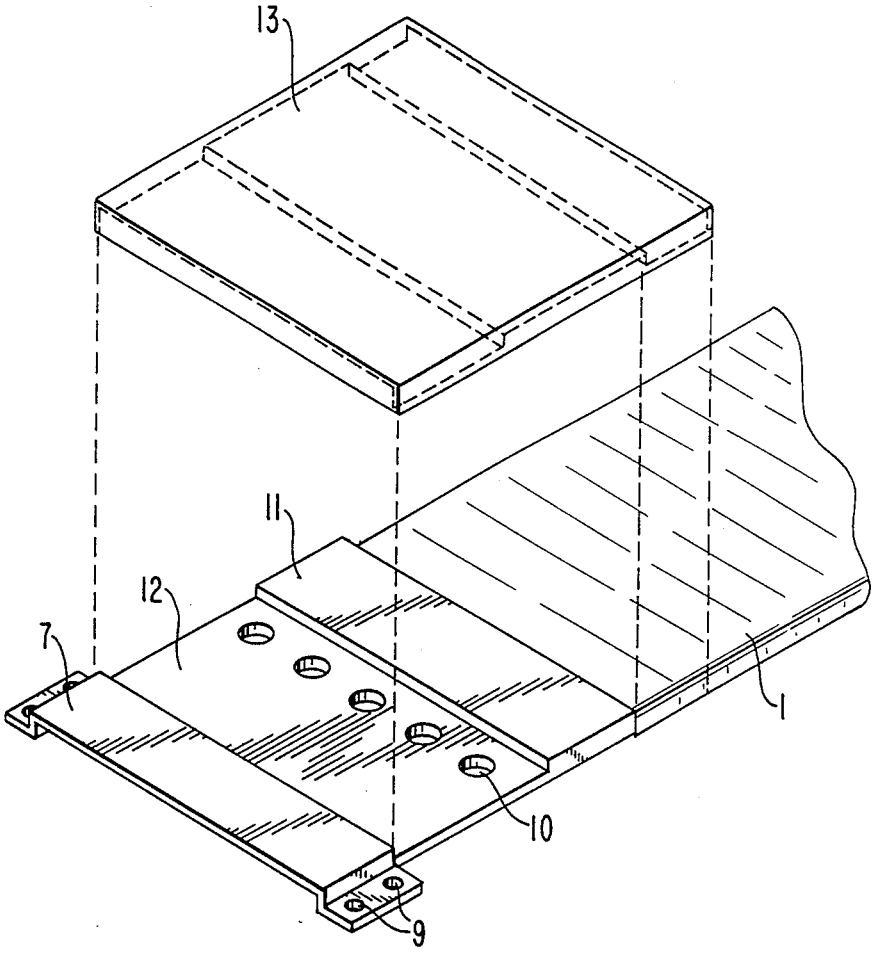
FIG. 2 is an exploded perspective view of a plastic strain relief cover depicted above a half of the connector shield on the same side in place on the connector shield and ribbon cable.

FIG. 2 depicts a plastic strain relief cover 13 in place over a connector shield half which covers ribbon cable 1 and is soldered to the cable shield of cable 1.

Figure 3:
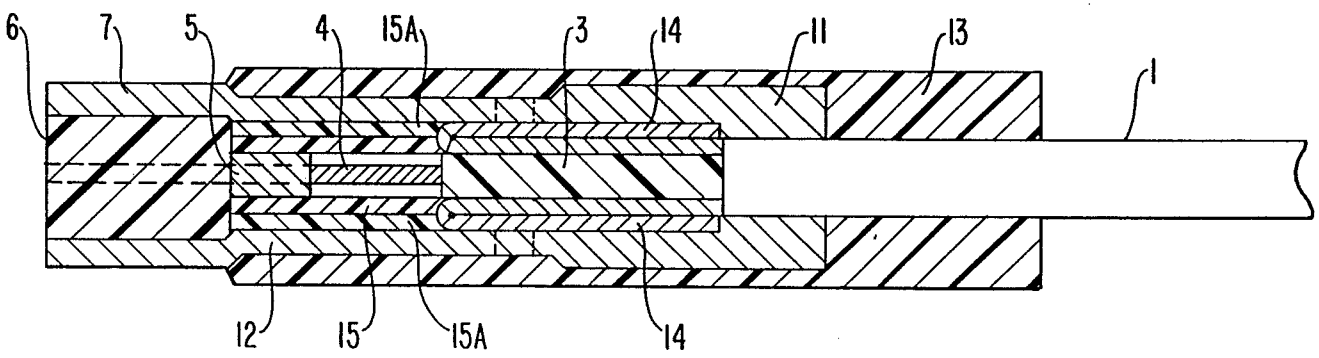
FIG. 3 describes a cross-section of the assembly with the various parts in place as assembled.

FIG. 3 describes a cross-section of the assembly of the invention, including cable conductor insulation 3, cable primary conductors 4, solder cup 5, plastic connector body 6, areas 7, 12. and 11 of the connector shield halves, plastic insulation wrap 15 surrounding the connection area of solder cup 5, optionally surrounded by a layer of electrically conductive polymer tape 15A. primary conductor 4, cable insulation 3, cable shielding 14 which is folded back over itself, plastic strain relief covers 13, and shielded ribbon cable 1 (not shown in cross-section).

Figure 4:
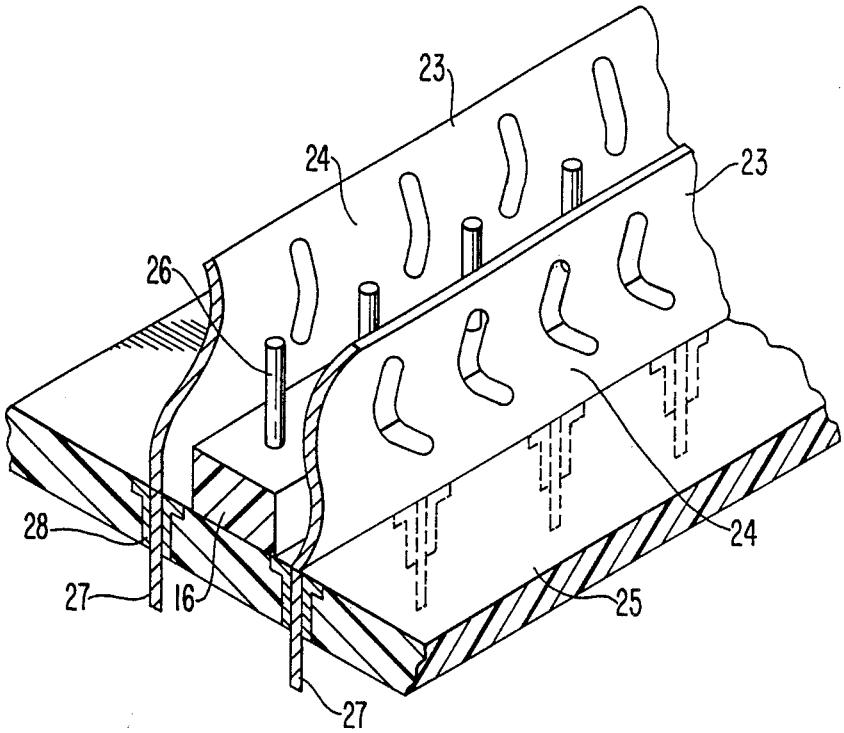
FIG. 4 shows a cross-section of a printed circuit board (PCB) with a receptacle shield and mating connector by which the assembly may be terminated on the PCB.

FIG. 4 shows a cross-section of PCB 25, with receptacle shields 23 connected to the ground plane of PC board 25 by pins 27 plugged into plated-through holes 28 in the board. Each shield 23 has slotted springy tine-like side portions 24 which form an electrical and mechanical connection with the assembly of the invention when the assembly is inserted into it. Mating connector 16 is shown with pins 26 aligned for mating with the assembly. Pins 26 may be of female configuration if the pins imbedded in connector body 6 are of male configuration.

The assembly described above uses about half the space currently used for flat shielded cables, is three hundred sixty degrees shielded from electromagnetic and radio frequency radiation, and is impedance matched to the flat cable impedance. These features also yield benefits in space required for PC board connection of and electrical performance when the assembly is connected thereto.

I claim:

1. A shielded connector assembly for flat ribbon cable comprising:

(a) a plastic insulation connector body enclosing an embedded array of standard connector pins spaced apart in a grid on no more than five-hundredths inch centers, said pins including exposed ends on a narrow face of said connector and including standard pin-mating opposite ends of said pins embedded in said connector on the face of said connector opposite said exposed pins;

(b) affixed to said exposed pins the ends of the primary electrical conductors of a fully-shielded and insulated flat ribbon electrical signal cable on which portions of the cable insulation surrounding said conductors are exposed and on which portions of the shielding of said cable are exposed and folded-back parallel to said cable;

(c) a polymer insulation ribbon wrapped around and encompassing the area including said connector pins, primary cable conductors, and said exposed cable insulation surrounding said conductors;

(d) a pair of conductive connector shields shaped to fit closely over and cover each side of the connector body, polymer insulation ribbon and folded-back cable shield areas of the assembly;

(e) a pair of insulative plastic strain relief covers shaped to fit closely over and cover each side of a portion of said connector shields and a portion of said adjacent flat ribbon cable;

(f) means to fasten said connector shields together and to said cable shield; and (g) means to fasten said insulative plastic strain relief covers together surrounding portions of said shields and said cable.

2. An assembly of claim 1 wherein said plastic insulative connector body comprises a molded thermoplastic material.

3. An assembly of claim 2 wherein said polymer insulation ribbon consists essentially of an aromatic polyimide polymer.

4. An assembly of claim 2 wherein said polymer insulation ribbon consists of a fluoropolymer.

5. An assembly of claim 4 wherein said fluoropolymer consists essentially of microporous polytetrafluoroethylene.

6. An assembly of claims 1, 2, 3, 4, or 5 wherein the insulation of said flat ribbon signal cable comprises microporous polytetrafluoroethylene.

7. An assembly of claim 1 mated with a fully-shielded receptacle for said assembly affixed to a printed circuit board.

8. An assembly of claim 1 wherein a layer of electrically conductive polymer tape surrounds said polymer insulation ribbon.

9. An assembly of claim 1 wherein said means for conductor attachment to said standard connector pins is selected from the group soldering cups, crimping receptacles, or insulation displacement contacts.

* * * * *